United States Patent [19]

Kitazawa et al.

[11] Patent Number: 4,676,135

[45] Date of Patent: Jun. 30, 1987

[54] VIBRATION PLATE FOR MUSIC BOX MOVEMENT

[75] Inventors: Yasuhide Kitazawa; Mikio Shibagaki; Motonori Usui, all of Nagano, Japan

[73] Assignee: Kabushiki Kaisha Sankyo Seiki Seisakusho, Nagano, Japan

[21] Appl. No.: 836,861

[22] Filed: Mar. 7, 1986

[30] Foreign Application Priority Data

Mar. 12, 1985 [JP] Japan ..... 60-34176[U]

[51] Int. Cl.[4] ..... G10F 1/06

[52] U.S. Cl. ..... 84/94 R; 84/408

[58] Field of Search ..... 84/94 R, 402, 408, 409, 84/95 R

[56] References Cited

U.S. PATENT DOCUMENTS 3,013,460 12/1961 Groux ..... 84/95 R

FOREIGN PATENT DOCUMENTS 107605 4/1899 Fed. Rep. of Germany ..... 84/94 R 18793 5/1857 France ..... 84/95 R

*Primary Examiner*—L. T. Hix

*Assistant Examiner*—Brian W. Brown

*Attorney, Agent, or Firm*—Sughrue, Mion, Zinn Macpeak & Seas

[57] ABSTRACT

A vibration plate for a music box having an improved tonal range and quality, yet with a reduced manufacturing cost. The vibrating reeds of the vibration plate are made smaller in width towards the highest frequency one of the reeds. Each of the reeds has a base portion and an end portion extending through a sloped portion from the base portion, the end portion being smaller in width than the base portion. The end portions of the reeds are arranged at equal intervals.

3 Claims, 7 Drawing Figures

VIBRATION PLATE FOR MUSIC BOX MOVEMENT

BACKGROUND OF THE INVENTION

The present invention relates to vibration plates for music box movements, and more particularly, to vibration plates having fifty to seventy vibration reeds for high-grade music box movements.

In a conventional vibration plate for music box movements, a number of vibrating reeds are arranged in the form of comb teeth of equal width. In a high-grade music box having a large number of reeds and capable of playing two or more music selections, in general, the reeds except for the lowest frequency reed are all equal in width to one another, and the end portion of each reed is tapered. Only the lowest frequency reed is made larger in width than the other reeds to provide for it a greater vibration energy.

In general, the vibration plate is divided roughly into three regions: a high frequency region, a middle frequency region, and a low frequency region.

In one example of a conventional vibration plate, as shown in FIG. 1 and FIG. 3B, each of reeds 5 includes a base portion 51, a sloped portion 52, and an end portion 53. In the greater part of the reeds 5, the sloped portion 52 forms an angle of 45° (a') with the longitudinal axis of the reed, and the sloped surfaces are about 1 mm in length. In the remaining 14 to 15 reeds 5, namely, those for higher frequencies, the sloped surfaces are about 4 mm in length. The vibration plate has mounting holes formed at equal intervals which are used to secure the vibration plate to the movement's frame with screws.

As shown in FIG. 2, a seat 57 is welded to the base part 54 of the vibration plate 4, which has a thickness of T'. Each of the reeds 5 extends from the base part and has a thin middle part 55 and a weight part 56. In the reeds for lower frequencies, the weight parts 56 are augmented, while on the other hand, in the reeds for high frequencies, the weight parts 56 are made thinner.

In a music box movement having a vibration plate 4 thus constructed, (1) the tonal range is small, and therefore the music selections employable are limited, (2) the tonal quality is not sufficiently high for a high-grade music box, (3) tones in the middle frequency range are unsatisfactory, being rather uncrispt and having insufficient reverberation, (4) the volume of sound in the high frequency range is not well balanced with that in the low frequency range, and (5) during assembly, a welding operation must be additionally performed, requiring much labor and time.

Therefore, in order to provide a high-grade music box movement, it is necessary to eliminate the above-described difficulties accompanying the conventional vibration plate.

SUMMARY OF THE INVENTION

An object of the invention is thus to provide a vibration plate for a music box movement which increases the high frequency range thereof and improves the tonal quality and the sound volume balance thereof, thereby allowing the music box movement to operate as a high-grade movement having excellent musical characteristics.

Another object of the invention is to provide a vibration of plate high tonal quality for a music box movement which can be manufactured by machining a piece of metal plate at low cost.

Specific features of the invention reside in a vibration plate for a music box movement which has a plurality of vibrating reeds arranged in the form of comb teeth, in which, according to one aspect of the invention, the reeds are made smaller in width towards the highest frequency vibration reed, and each reed comprises a base portion, and an end portion extending through a sloped portion from the base portion, the end portion being smaller in width than the base portion, and the end portions of the reeds are arranged at equal intervals. Moreover, according to another aspect of the invention, the sloped surfaces of the sloped portion of each of the reeds other than those for lower frequencies form an angle of 35° or less with respect to the longitudinal axis thereof, and the sloped portions of at least one-third of the reeds, specifically, those for higher frequencies, are made longer in length towards the highest frequency reed. Further, according to yet another aspect of the invention, the length of the sloped portion of the highest frequency reed is at least half the length of the reed. Still further, according to another aspect of the invention, the intervals of holes formed in the vibration plate to secure the latter to the frame of the music box movement are made shorter towards the highest frequency reed. And, according to still another aspect of the invention $T/t>4$ where T is the thickness of the vibration plate and t is the thickness of a thin middle part included in each of the reeds.

DESCRIPTION OF THE PREFERRED EMBODIMENT

Figure 4:
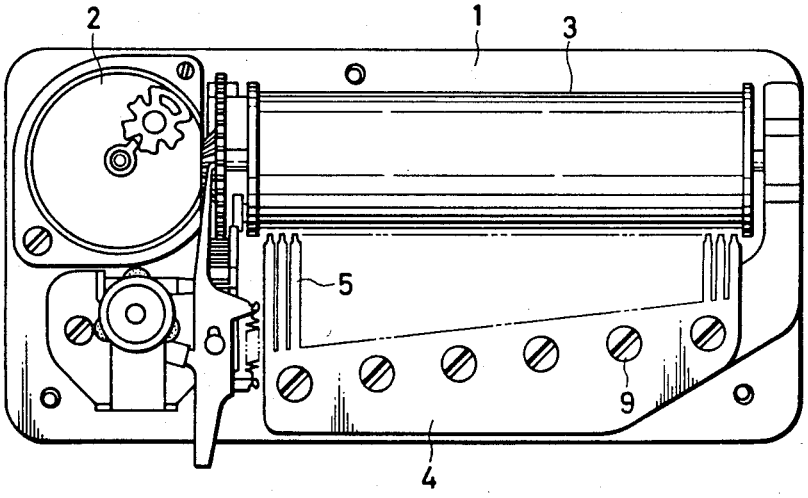
FIG. 4 is a plan view of a music box movement employing a vibration plate according to the invention.
Figure 5:
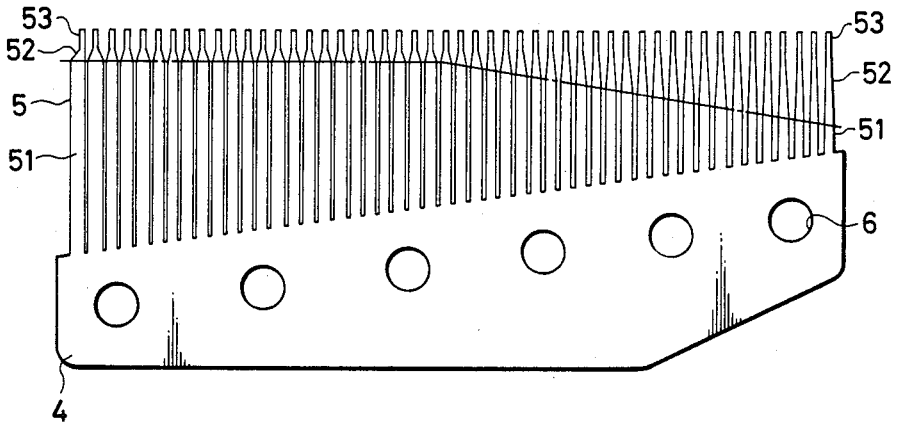
FIG. 5 is a plan view of the vibration plate shown in FIG. 4.

As shown in FIG. 4, a cup-shaped box 2 is fixedly provided in one corner of the frame 1 of a music box movement. The cup-shaped box 2 incorporates a coil spring (the drive source for the movement) and a gear driven by the coil spring. A drum 3 is rotatably mounted on the frame 1. The drum 3 is driven through the drive gear by the elastic force of the coil spring. The base part of a vibration plate, having a number of vibrating reeds 5 arranged in the form of comb teeth, is secured to the seat part of the frame 1 with screws 9. The vibration plate, as shown in FIG. 5, can be broken into three regions; a low frequency region, a middle frequency region, and a high frequency region, with each region constituting about one-third of the plate. In the vibration plate, the longer reeds are for lower frequencies, while the shorter reeds are for higher frequencies.

The sequence of plucking of the reeds is of course determined according to the piece of music to be played.

As shown in FIG. 5, holes 6 are formed in the base part of the vibration plate 4 near the base portions of the reeds 5, and the aforementioned screws 9 are inserted into the holes to secure the vibration plate 4 to the seat part of the frame 1 so that the vibration of the reeds 5 when plucked by the drum 3 is transmitted through the seat part to the frame 1.

Figure 3A:
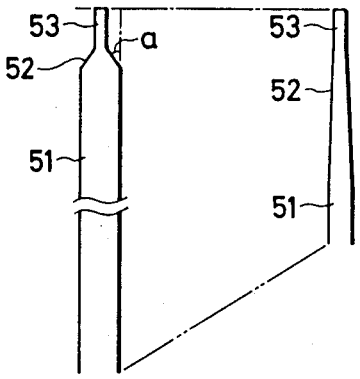
FIG. 3A is an enlarged view of a part of a vibration reed shown in FIG. 5.
Figure 3B:
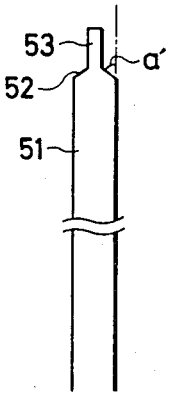
FIG. 3B PRIOR ART
FIG. 3B is an enlarged view of a part of a vibration reed shown in FIG. 1.

As shown in FIG. 5 and 3B, each of the reeds 5 has a base portion 51, a sloped portion 52, and an end portion 53. All the end portions 53 have the same configuration, being about 2 mm in length and 0.6 mm in width, and are spaced by about 1.2 mm. The sloped parts 52 of about half the reeds, i.e., the sloped parts 52 of the reeds for lower frequencies, have the same configuration. On the other hand, the sloped parts 52 of the remaining reeds are made gradually longer towards the right-hand end reed in the figure (the highest frequency reed). The sloped parts 52 are bordered by the base portions 51, as indicated by a single-dot/chain line; that is, the base portions 51 are made shorter towards the right-hand end reed while the base portions 51 of about half the reeds, i.e., the base portions 51 of the reeds for higher frequencies, are abruptly decreased in length. Also, the base portions 51 are made smaller in width towards the right-hand reed. However, the adjacent base portions may be made equal in width to each other as the case may be. The reeds can be readily and accurately formed by machining a plate according by employing a wire-electrode type electric discharge machining method.

The end portions 52 of the reeds 5, except for those of the two lowest frequency reeds, are formed so that the angle a with respect to the longitudinal axis is 35° or smaller (FIG. 3A).

In the two lowest frequency reeds, the angle a is made larger than 35° in order to increase the mass of the reed to obtain a larger vibration energy.

The inside diameter of each of the holes 6 is somewhat larger than the diameter of the base part of each of the screws 9 so that the vibration plate 4 can be fixedly mounted on the frame 1 by tightening the screws 9 after the positional relationship (the amount of engagement) between the reeds 5 and pins fixed to the frame has been adjusted. The interval at which the hole 6 are formed is smaller towards the right-hand reed in Fig. 5 (the highest frequency). This is done to more positively transmit the high frequency sounds to the frame 1 (which is other wise difficult to accomplish). That is, the music box movement of the invention is designed so that the vibration of each of the high frequency reeds is positively transmitted to the frame 1 by collectively depressing the part of the vibration plate in the vicinity of the high frequency reeds. In order to positively transmit the vibration of the reeds 5 to the frame 1, it is preferable that, as shown in FIG. 5, the holes 6 be located closer to the reeds 5.

Figure 6:
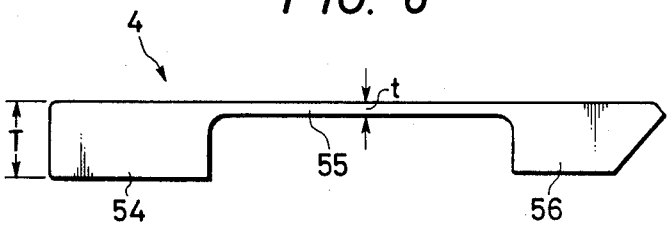
FIG. 6 is side view showing the configuration of the vibration plate according to the invention.

Next, the relationships between the vibration plate and the thin middle parts of each of the vibration reeds will be described with reference to FIG. 6.

A metal plate having a thickness T is machined by milling to obtain the vibration plate 4. The reeds 5 (only one being shown in FIG. 6) has a common base part 54 whose thickness is equal to the thickness T of the metal plate. The end portion of the reed 5 is formed into a weight part 56. The middle portion of the reed 5 (between the weight part 56 and the base part 54) is formed into a thin middle part 55. The thickness t of the thin middle part 55 is defined by the following condition:

$$T/t > 4$$

Furthermore, the weight parts 56 of reeds are made smaller and in mass towards the right-hand reed in FIG. 5.

The vibration plate 4 is formed as follows: A metal plate having a thickness T is machined in the form of comb teeth according to the number of reeds required, and then the thin middle parts 55 are formed by machining the teeth uniformly. Thereafter, the teeth are subjected to machining and polishing to form the weight parts 56. Weight members made, for instance, of lead are welded to the weight parts as the case may be. Each vibration reed is tuned to a predetermined frequency by machining its thin middle part 55. The thickness of the thin middle part thus formed is represented by t.

In view of the manufacturing cost of the vibration plate, it is preferable that the value T/t be close to unity because the required amount of machining of the metal plate is less in that case. On the other hand, in order to improve the tonal quality of each reed, the decay period of its vibration should be long. Theoretically, as the value T/t is increased, i.e., as the thickness t is decreased, the vibration energy provided through the base part 54 is decreased and the tonal quality is improved, while on the other hand, as the value T/t is decreased, the vibration energy provided through the base part is increased and the tonal quality becomes worse. If T=t, then the vibration energy is lost, straining the base part.

The present inventor has analyzed the vibration plate employing the stress freezing method and found that the surface strain of the base part 54 decreases abruptly with a certain value of T/t as a threshold, namely, a value of T/t of about 4 to 5. That is, when the thickness t of the thin middle part 55 is set to about ¼ to 1/5 the thickness T of the base portion 54, then the loss of the vibration energy is decreased and the tonal quality is improved. As the thickness t is made smaller, the loss of the vibration energy is further decreased; however, the tonal quality is not so remarkably improved and the durability of the reeds is reduced.

Specific examples of the thickness T of the metal plate and the thickness t of the thin middle part of the reeds will be described.

Figure 1:
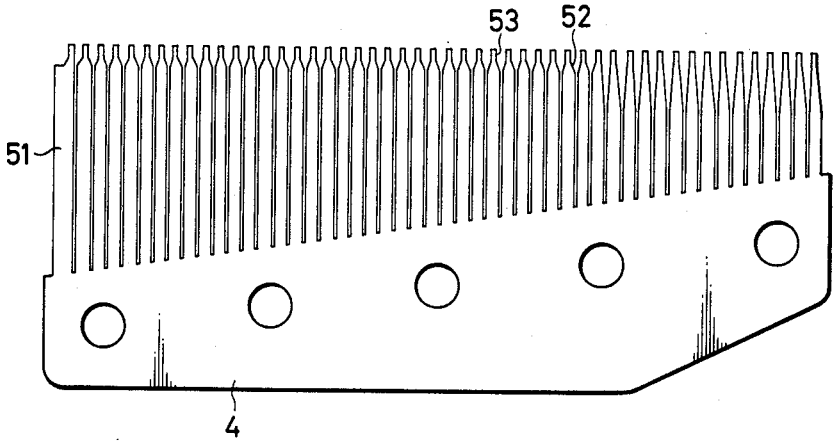
FIG. 1 PRIOR ART
FIG. 1 is a plan view of a conventional vibration plate.
Figure 2:
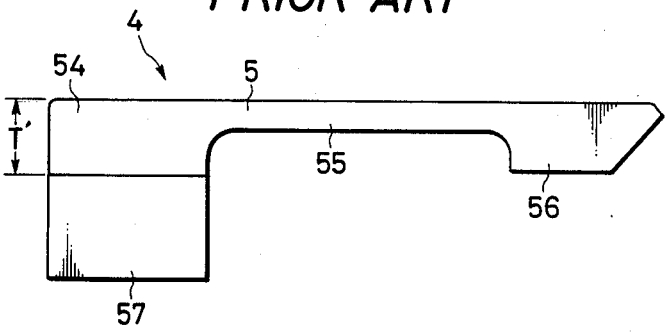
FIG. 2 PRIOR ART
FIG. 2 is a side view showing the configuration of a conventional vibration plate.

A metal plate 2.2 mm thick was machined and tuned as described above to obtain a vibration plate having reeds whose thin middle parts had a thickness t of 0.39 mm (for higher frequencies) to 0.49 mm (for lower frequencies). The vibration plate thus formed was fixedly mounted on a frame with screws without using a seat (reference numeral 57 in FIG. 2). When the music box thus constructed was played, the desired tonal colors were obtained. In the above-described case, the value of T/t was 5.64 to 4.49.

As stated above, value of T/t should be at least 4; however, it is preferably 4.5 to 5.0 when machining costs and the required degree of tonal quality are taken into consideration. In other words, if a metal plate which is 4.5 to 5 times as thick as the thin middle part (the vibration frequency determining portion) is machined to form a vibration plate, then a desired tonal color can be obtained without welding the seat to the base part.

While the invention has been described with reference to a vibration plate for large music boxes, it goes without saying that the technical concept of the invention is applicable to vibration plates for smaller music boxes.

In the above-described embodiment, the angle of the sloped surface of the sloped portion of each reed is set to 35° or less; that is, the angle is made acute to obtain sounds which are crisp and reverberant. Specifically, for the reeds for producing sounds in the middle frequency range and in the high frequency range, the angle is preferably 25° to 35° in view of the mass of the reed.

In the above-described embodiment, the sloped surfaces of at least a third of the reeds, namely, the sloped surfaces of the reeds for higher frequencies, are made longer towards the reed of highest frequency. This is done to further decrease the deflection torque of the reeds for higher frequencies to well balance the high and low frequency sounds in volume, and thereby to extend the available high frequency range. The same effect can be obtained by elongating the sloped surfaces of the reeds beginning with those for middle frequencies.

When the length of the sloped surfaces of the highest frequency reed is set to more than half the length of the reed, the tone quality, the frequency range, and the sound volume balance are significantly improved.

In the vibration plate according to the invention, the reeds are made smaller in width towards the highest frequency reed. Therefore, the reeds in the middle and high frequency ranges are improved in tone quality, and the high frequency range is extended. As the middle and high frequency reeds are made smaller in width, the amount of machining needed to form the reeds is decreased, which contributes to an improvement of manufacturing efficiency.

As the angle of the sloped surfaces of the reeds is set to 35° or less, especially the middle frequency reeds are improved in crispness. As the sloped surfaces of the high frequency reeds are made longer, the above-described effect becomes more significant, and especially the tonal range is increased and the tonal quality is improved.

A musical box manufactured by securing the above-described vibration plate having reeds formed as described to a frame with fixing screws provides excellent tonal quality. Moreover, the inventive vibration plate can be readily manufactured at a low cost.

We claim:

1. A vibration plate for a music box movement, comprising:

a plurality of vibrating reeds (5) extending in parallel from a base part (4) of a vibrating plate from a low frequency end thereof to a high frequency end, the vibrating plate including a low frequency region, a middle frequency region and a high frequency region;

each of the reeds comprising a base portion (51), a sloped portion (52) contiguous with the base portion, and an end portion (53) contiguous with the sloped portion;

wherein the reeds progressively decrease in width towards the high frequency end of the vibrating plate;

the sloped portions of each reed in the middle and high frequency regions have a slope surface forming an angle of not more than 35° with respect to a longitudinal axis of the reed;

the sloped portions of the reeds in the middle and high frequency regions progressively increase in length towards the high frequency end;

the sloped portions of the reeds at the high frequency end have a length at least half their total length; and the end portions of the reeds are spaced at equal intervals.

2. The vibration plate as recited in claim 1, wherein:

at least three holes are formed in a base part of said vibration plate, intervals of said holes being shorter towards said highest frequency reed.

3. The vibration plate as recited in claim 1, wherein:

said vibration plate is formed from a metal plate having a thickness of T, and each reed includes a thin middle part of thickness t, wherein said T and t satisfy:

$$T/t > 4.$$

* * * * *